US007866776B2

(12) United States Patent
Watanabe

(10) Patent No.: US 7,866,776 B2
(45) Date of Patent: Jan. 11, 2011

(54) INK JET HEAD DRIVING METHOD, INK JET HEAD AND INK JET RECORDING APPARATUS

(75) Inventor: Toshiaki Watanabe, Chiba (JP)

(73) Assignee: SII Printek Inc. (JP)

( * ) Notice: Subject to any disclaimer, the term of this patent is extended or adjusted under 35 U.S.C. 154(b) by 129 days.

(21) Appl. No.: 11/502,190

(22) Filed: Aug. 9, 2006

(65) Prior Publication Data

US 2007/0035568 A1 Feb. 15, 2007

(30) Foreign Application Priority Data

Aug. 12, 2005 (JP) ..... 2005-234337

(51) Int. Cl.
*B41J 29/38* (2006.01)
*B41J 2/045* (2006.01)

(52) U.S. Cl. ..... 347/10; 347/68

(58) Field of Classification Search ..... 347/10, 347/9, 11, 68
See application file for complete search history.

(56) References Cited

U.S. PATENT DOCUMENTS

| | | | | |
|---|---|---|---|---|
| 6,328,397 | B1 | 12/2001 | Shimizu et al. | 347/10 |
| 2003/0016256 | A1* | 1/2003 | Harvey et al. | 347/10 |
| 2004/0155915 | A1* | 8/2004 | Kitami et al. | 347/10 |

* cited by examiner

*Primary Examiner*—Matthew Luu
*Assistant Examiner*—Jannelle M Lebron
(74) *Attorney, Agent, or Firm*—Adams & Wilks

(57) ABSTRACT

In an ink jet head driving method, a first drive pulse signal is transmitted to a first actuator that is formed in a first ink chamber confronting a print area on a recording medium and from which ink is to be discharged. The first drive pulse signal comprises a reserve drive pulse signal transmitted to temporarily increase a volume of the ink chamber and a discharge drive pulse signal transmitted sequentially with the reserve drive pulse signal to temporarily reduce the volume of the ink chamber and thereby cause ink to be discharged from the first ink chamber. In synchronization with the reserve drive pulse signal, a second drive pulse signal is transmitted to a second actuator that is formed in a second ink chamber confronting a non-print area of the recording medium adjacent to the print area thereof and that is configured to discharge ink. The second drive pulse signal has one of a voltage value and a pulse width at which the volume of the second ink chamber is varied but does not cause ink to be discharged from the second ink chamber.

21 Claims, 9 Drawing Sheets

INK JET HEAD DRIVING METHOD, INK JET HEAD AND INK JET RECORDING APPARATUS

BACKGROUND OF THE INVENTION

1. Field of the Invention

The present invention relates to an ink jet recording apparatus for a printer or a facsimile machine, and to an ink jet head used for the ink jet recording apparatus, a nozzle plate used for the ink jet head, an apparatus for manufacturing the nozzle plate and a method for manufacturing the nozzle plate.

2. Related Background Art

An ink jet recording apparatus is known that records characters and images on a recording medium by employing an ink jet head wherein a plurality of ink chambers, made of a piezoelectric material for which a poling process has been performed, are arranged in parallel, and electrodes are mounted on two inner walls of the individual ink chambers, and wherein the piezoelectric material is deflected by selectively transmitting a drive pulse signal to these electrodes, and to thus discharge ink from a plurality of nozzle openings that communicate with the ink chambers. This ink jet recording apparatus moves a carriage, on which the ink jet head is mounted, in the main scanning direction relative to the recording medium, and discharges ink from the nozzles of the ink jet head to print a dot pattern in a predetermined area. When one main scanning has been completed, the ink jet recording apparatus moves the recording medium a predetermined distance in the sub-scanning direction, and repeats the above described operation to print all the desired area.

For such an ink jet head, since an ink chamber shares a side wall with adjacent ink chambers, the discharge of ink in the ink chamber is affected by the driving condition of the peripheral ink chambers. Further, since the pressure in the ink chamber fluctuates during driving, the preceding state, i.e., whether the ink chamber has been driven, also affects the discharge of the ink in the ink chamber.

Assume that to print a linear line an ink jet head is moved from the left to the right, and discharges ink from nozzles (discharge portions) of the predetermined contiguous portion of the ink jet head. In this case, as shown in FIG. 10A, a line would be printed that is curved at the ends. FIG. 10A is a diagram showing ink droplets that landed at this time, and FIG. 10B is a specific diagram showing the nozzle plate used for printing this line. Such a line, one curved at the ends, is printed because the ink discharge speed is low for nozzles located near portions whereat ink is not discharged, and ink droplets do not land at targeted discharge positions. That is, the difference in the discharge speed causes a shift in the landing time for ink droplets on a recording medium, i.e., the shifting of the dot positions, and accordingly, the printing quality is deteriorated. Specifically, of the nozzle openings 28 arranged in a discharge portion, the ink discharge speed for the nozzle opening 28*a* located nearest the non-discharge portion is 70 to 80% that of the ink discharge speed for the nozzle opening 28*x* located in the middle of the discharge portion.

As described above, the factor responsible for the reduction in the speed of the ink discharged from the nozzle located near the non-discharge portion may be that there is a small pressure change in the ink chamber consonant with the pertinent nozzle. That is, for this type of ink jet head chip, ink chambers that share a side wall are formed in parallel by cutting a single piezoelectric ceramic plate. Therefore, since one specific ink chamber receives pressure vibrations from adjacent ink chambers, the internal pressure vibration in the specific ink chamber is affected. And when only one adjacent ink chamber is driven, the pressure fluctuation in the specific ink chamber is reduced, compared with when all the peripheral ink chambers are driven. This trend is noticeable immediately after a printing operation is started that employs ink chambers that had not previously been driven. And when ruled lines and characters are printed, the curving of straight lines is outstanding.

To address the difference in the speed of ink droplets discharged from an ink chamber, an ink jet recording head driving method is proposed. According to this method, it is first determined whether ink chambers adjacent to a specific ink chamber were driven before being currently driven, and in accordance with the determination results, a wave having a different drive pulse is applied.

However, according to this method, in order to determine, at each ink discharge time, whether the ink chambers adjacent to the specific ink chamber have been driven, a special dedicated circuit and a controller are required, and the manufacturing cost is increased.

SUMMARY OF THE INVENTION

While taking these problems into account, it is one objective of the present invention to remove, by employing a simple control process, a difference in the speed at which ink is discharged from a nozzle array.

To achieve this objective, according to a first aspect of the present invention, an ink jet head driving method comprises the steps of:

transmitting a first drive pulse signal, by which the discharge of ink is enabled, to an actuator that is formed, based on print data received from an external circuit, in an ink chamber located facing a print area on a recording medium, and that changes the volume of the ink chamber, independently; and transmitting a second pulse signal, having a voltage value or a pulse width at which discharge of ink does not occur, to an actuator that is formed in an ink chamber, which is located opposite a non-print area of the recording medium adjacent to the print area and for which the discharge of ink is available, and that changes the volume of the ink chamber, independently. According to this arrangement, a weak vibration is also applied to an ink chamber, adjacent to an ink chamber from which ink is discharged, from which no ink is actually discharged. Thus, constant ink discharge speeds can be ensured for all ink discharge nozzles.

According to a second aspect of the invention, for the ink jet head drive method, the first drive pulse signal includes: a reserve drive pulse signal, for temporarily increasing the volumes of the ink chambers; and a discharge drive pulse signal, which is contiguous with the reserve drive pulse signal, for temporarily reducing the volumes of the ink chambers, and the second drive pulse signal is generated in consonance with the reserve drive pulse signal. According to this arrangement, the load imposed on a side wall can be reduced, and the ink discharge speeds can effectively be adjusted.

According to a third aspect of the invention, for the ink jet head drive method, the second drive pulse signal is transmitted at the same time as the reserve drive pulse signal. Thus, the phases of the pressure vibrations in the ink chambers will match, and ink discharge stability will be obtained.

According to fourth and fifth aspects of the invention, for the ink jet head drive method, a pulse width for the second drive pulse signal is 30 to 60% that of the reserve drive pulse signal, and the voltage value is equal to that of the reserve drive pulse signal. Since the pulse width of an input drive pulse signal is designated a predetermined pulse width, unnecessary discharge of ink can be avoided, and stability of the ink discharge speed can effectively be ensured.

According to a sixth aspect of the invention, for the ink jet head drive method, before the first drive pulse signal is input, a third drive pulse signal, having a voltage value or a pulse width at which ink discharge does not occur, is transmitted to the ink chamber opposite the print area of the recording medium. Thus, immediately after the discharge of ink is started, the optimal ink discharge speed can be obtained.

According to a seventh aspect of the invention, for the ink jet head drive method, the third drive pulse signal has the same waveform as has the second drive pulse signal.

Therefore, by simply changing the setup of a drive waveform, uniform states can be provided for the individual ink chambers that discharge ink, without having to change a conventional drive circuit.

According to an eighth aspect of the invention, for the ink jet head drive method, the ink chambers are separated by side walls on which electrodes are formed on either face, and are arranged in parallel. Since the drive method of this invention is employed for a shared-wall type ink jet head, stability can effectively be provided for the ink discharge speeds.

According to a ninth aspect of the invention, an ink jet head comprises:

an ink jet head chip, including a plurality of ink chambers, in which ink supplied by an ink supply unit is retained, and an actuator, for changing the ink chamber volumes; and a drive unit, for transmitting a first drive pulse signal, by which discharge of ink is enabled, to an actuator that is provided, based on print data received from an external circuit, in an ink chamber opposite a print area on a recording medium, and for transmitting a second drive pulse signal, having a voltage value or a pulse width at which ink is not discharged, to an actuator, at the least, that is provided in an ink chamber, located opposite a non-print area on the recording medium that is adjacent to the print area onto which ink is to be discharged.

According to a tenth aspect of the invention, an ink jet recording apparatus comprises:

the ink jet head of the ninth aspect;

an ink supply unit for supplying ink to the ink jet head; and a recording medium convey portion, for conveying a recording medium onto which ink is discharged by the ink jet head. With this arrangement, an excellent printing quality recording medium can be provided.

As described above, according to the ink jet recording apparatus and the ink jet head drive method of the invention, by employing a simple control process, the differences in the ink discharge speeds can be removed, the ink discharge stability can be increased, and the image quality can be improved. Further, since weak vibrations are applied in advance, before ink is discharged, ink can be discharged from all the nozzles at an optimal speed immediately after the printing is started. Thus, the reliability, for example, of the printing speed and the printing quality capabilities of the recording medium can be increased.

DETAILED DESCRIPTION OF THE PREFERRED EMBODIMENTS

The preferred embodiments of the present invention will now be described in detail.

Figure 1:
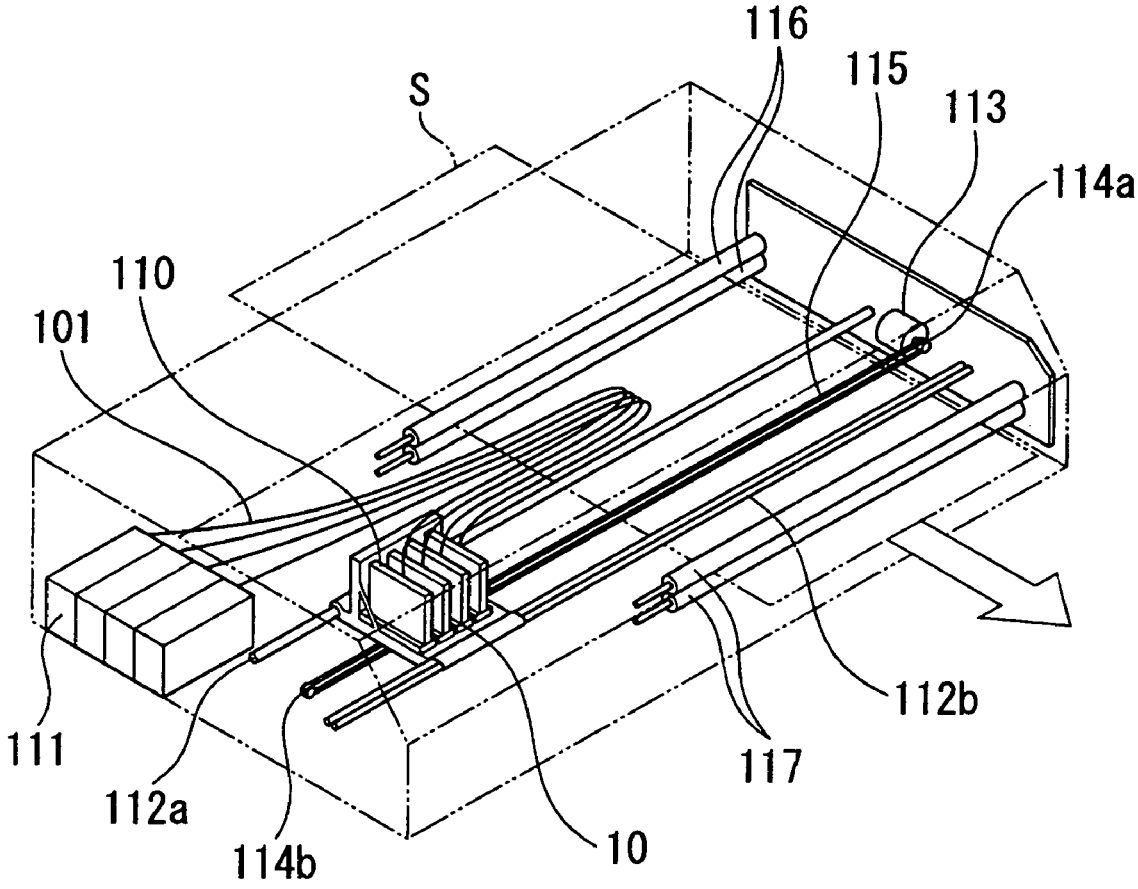
FIG. 1 is a schematic perspective view of an ink jet recording apparatus.

FIG. 1 is a schematic perspective view of an ink jet recording apparatus. As shown in FIG. 1, the ink jet recording apparatus for this embodiment includes: a plurality of ink jet heads 10 provided for individual colors; a carriage 110, wherein the ink jet heads 10 are mounted, in parallel, in the main scanning direction; and ink cartridges 111, for supplying ink through ink supply tubes 101, which are flexible tubes. The carriage 110 reciprocates along a pair of guide rails 112*a* and 112*b* in the direction of their long axis. A drive motor 113 is located at one end of the guide rails 112*a* and 112*b*, and the drive force exerted by the drive motor 113 is transmitted to a timing belt 115 that is extended between a pulley 114*a*, which is connected to the drive motor 113, and a pulley 114*b*, which is located at the other end of the guide rails 112*a* and 112*b*. The carriage 110, fixed at a predetermined position on the timing belt 115, is then moved.

Further, at both ends of a case indicated by a broken line, a pair of conveying rollers 116 and 117 are provided as conveying means extending along the guide rails 112*a* and 112*b* for conveying a recording medium S in a direction perpendicular to a direction in which the carriage 110 is moved. These conveying rollers 116 and 117 move the recording medium S downward relative to the carriage 110 in the direction perpendicular to the direction in which the carriage 110 is moved.

When the recording medium S is fed by the conveying rollers 116 and 117, while at the same time scanning is performed by moving the carriage 110 in the perpendicular direction, characters and images are printed on the recording medium S by the ink jet head 10.

Figure 2:
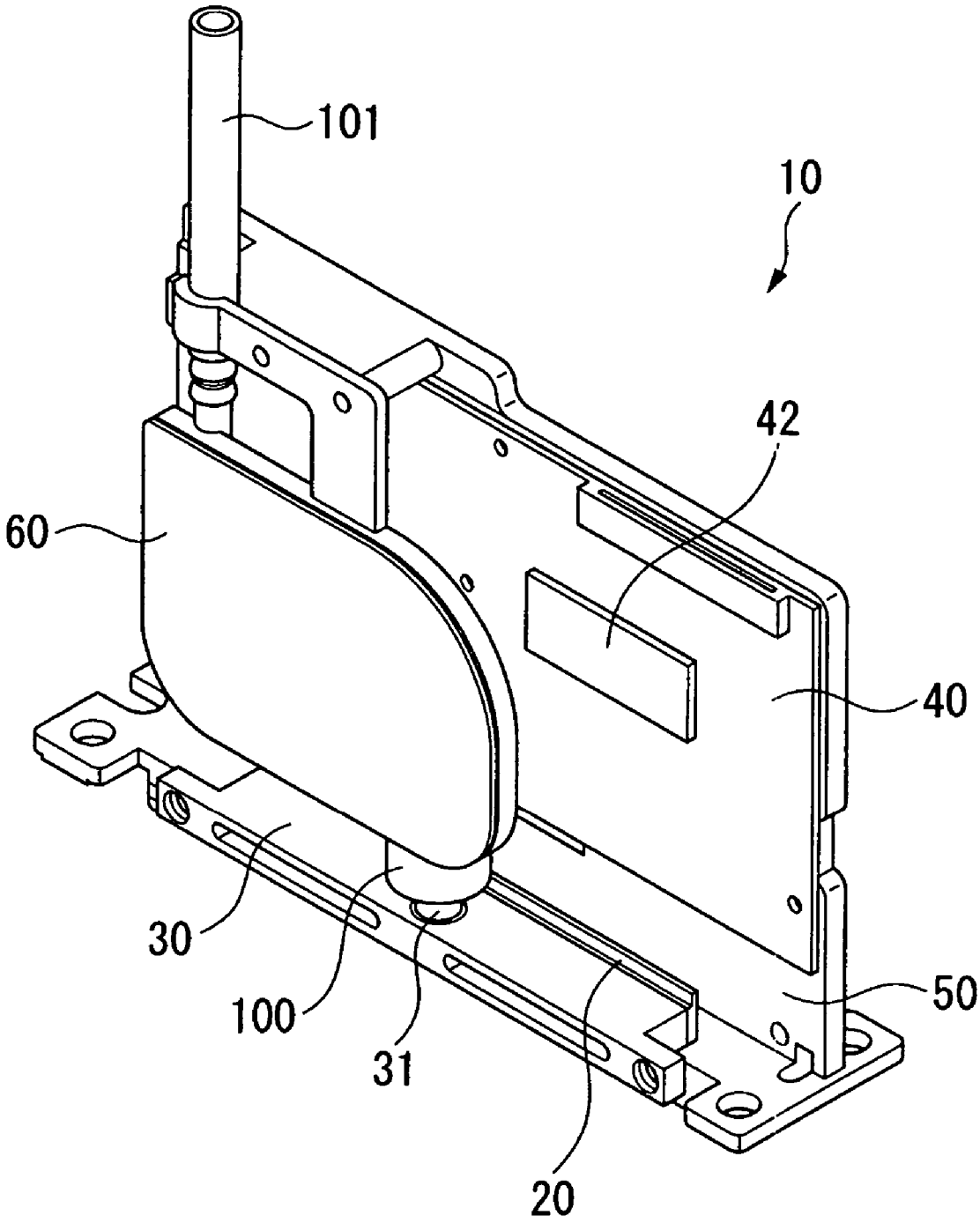
FIG. 2 is a perspective view of an ink jet head.
Figure 3A:
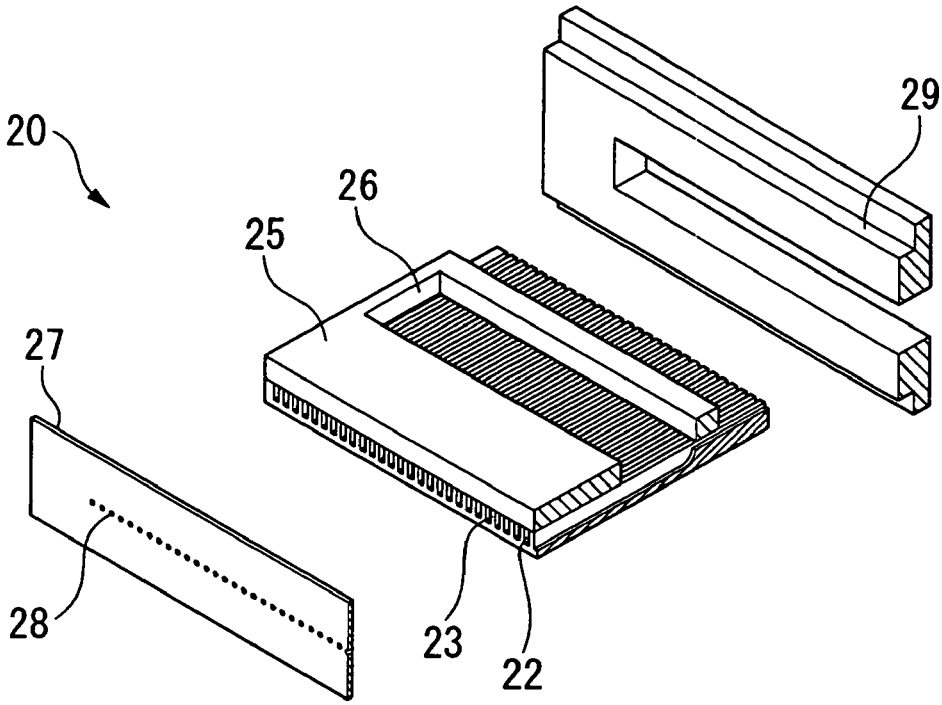
FIGS. 3A and 3B are exploded perspective views of an ink jet head chip.
Figure 3B:
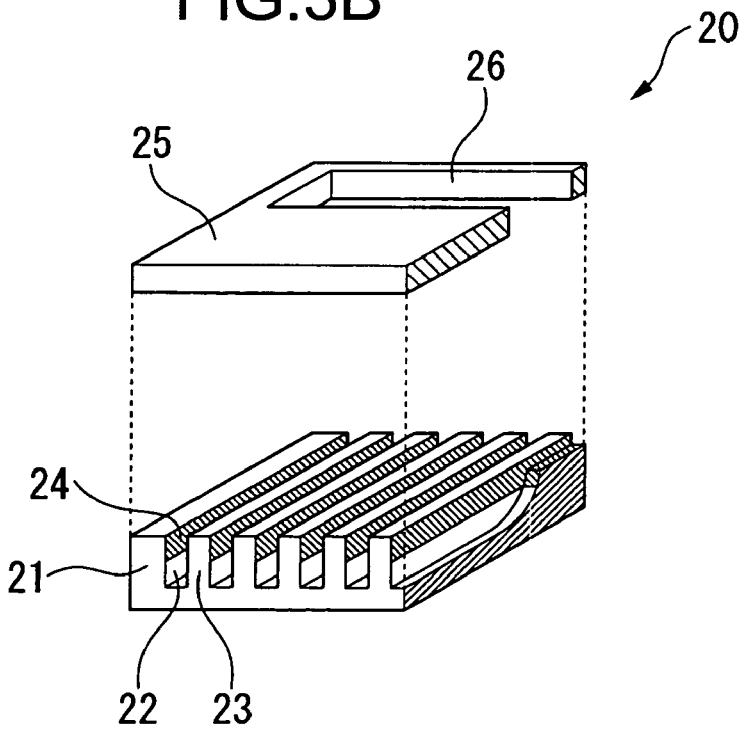

An example of an ink jet head that discharges ink will now be explained. FIG. 2 is a perspective view of an ink jet head according to the first embodiment, and FIGS. 3A-3B are exploded perspective views of an ink jet head chip.

As shown in FIG. 2, the ink jet head 10 for this embodiment includes: an ink jet head chip 20; a flow path substrate 30, provided on one side of the ink jet chip 20; and a wiring substrate 40, on which is mounted a drive circuit 42 for driving the ink jet head chip 20. These members are fixed to a base plate 50, which is a head support member made, for example, of aluminum. Further, these members are coupled together by using a thermal conductive adhesive or double-sided tape.

A piezoelectric ceramic plate 21 that constitutes the ink jet head chip 20 is made, for example, of PZT (lead zirconate titanate), and a plurality of ink chambers 22 that communicate with nozzle openings 28 are formed in parallel in the piezoelectric ceramic plate 21. The individual ink chambers 22 are separated by side walls 23. The longitudinal ends of the ink chambers 22 are extended to one end face of the piezoelectric ceramic plate 21, while the other ends are not extended to the other end face, and the depths of the chambers 22 are gradually reduced. Further, on the side walls 23 in the widthwise direction of the ink chambers 22, electrodes 24 that independently output drive signals for the ink chambers 22 are formed in the longitudinal direction on the open side of the ink chambers 22.

The ink chambers 22 are formed in the piezoelectric ceramic plate 21 by a disc-like die cutter, for example, and the portions wherein the depth is gradually reduced are formed by using the shape of a die cutter. Further, the electrodes 24 are formed in the individual ink chambers 22, for example, by a well known vapor deposition method performed in the oblique direction. As described above, the ink jet head chip 20 of this embodiment employs a shared wall structure wherein a plurality of ink chambers 23 that have actuators for changing the volumes of the corresponding ink chambers 23 are sandwiched by side walls 23, made of PZT, and are arranged by sharing the side walls 23.

Further, an ink chamber plate 25 is connected to the piezoelectric ceramic plate 21 where the ink chambers 22 are open. A common ink chamber 26 is formed that penetrates the ink chamber plate 25 and covers all the parallel arranged ink chambers 22.

A nozzle plate 27 is coupled to one end of the assembly composed of the piezoelectric ceramic plate 21 and the ink chamber plate 25, and nozzle openings 28 are formed at locations in the nozzle plate 27 consonant with those of the ink chambers 22. The nozzle plate 27 is a polyimide film wherein the nozzle openings 28 are formed by using, for example, an excimer laser device. Further, in order to prevent the attachment of ink, a water-repellent film is deposited on the face of the nozzle plate 27 opposite the recording medium S.

In this embodiment, a nozzle support plate 29 is peripherally located near one end face of the assembly composed of the piezoelectric ceramic plate 21 and the ink chamber plate 25. The ink jet head chip 20 is provided by fitting and adhering the nozzle support plate 29 to the assembly consisting of the side face of the nozzle plate 27 and to the assembly consisting of the piezoelectric ceramic plate 21 and the ink chamber plate 25.

Furthermore, the flow path substrate 30 is connected to one side of the ink chamber plate 25 (the upper face in (FIGS. 3A-3B), and one side of the common ink chamber 26 is sealed by this flow path substrate 30. Specifically, the flow path substrate 30 is adhered to one side of the ink chamber plate 25, and is fixed to the base plate 50 by a screw member (not shown), for example.

In addition, a coupling portion 31 is provided for the upper face of the flow path substrate 30, and is connected, for example, via an O-ring to an ink channel tube 100 provided for a pressure adjustment unit 60. The other end of the pressure adjustment unit 60 is connected via the ink supply tube 101 to an ink tank, such as an ink cartridge, to provide temporarily storage for a predetermined amount of ink.

The drive circuit 42 and another control circuit are mounted on the surface of the wiring substrate 40, and wire bonding, or wireless bonding, for example, is employed to establish an electrical connection with the terminals of the drive circuit 42, which is an IC chip, to drive lines 43 (FIG. 4) that are to be connected to the electrodes 24 of the ink jet head chip 20.

Figure 4:
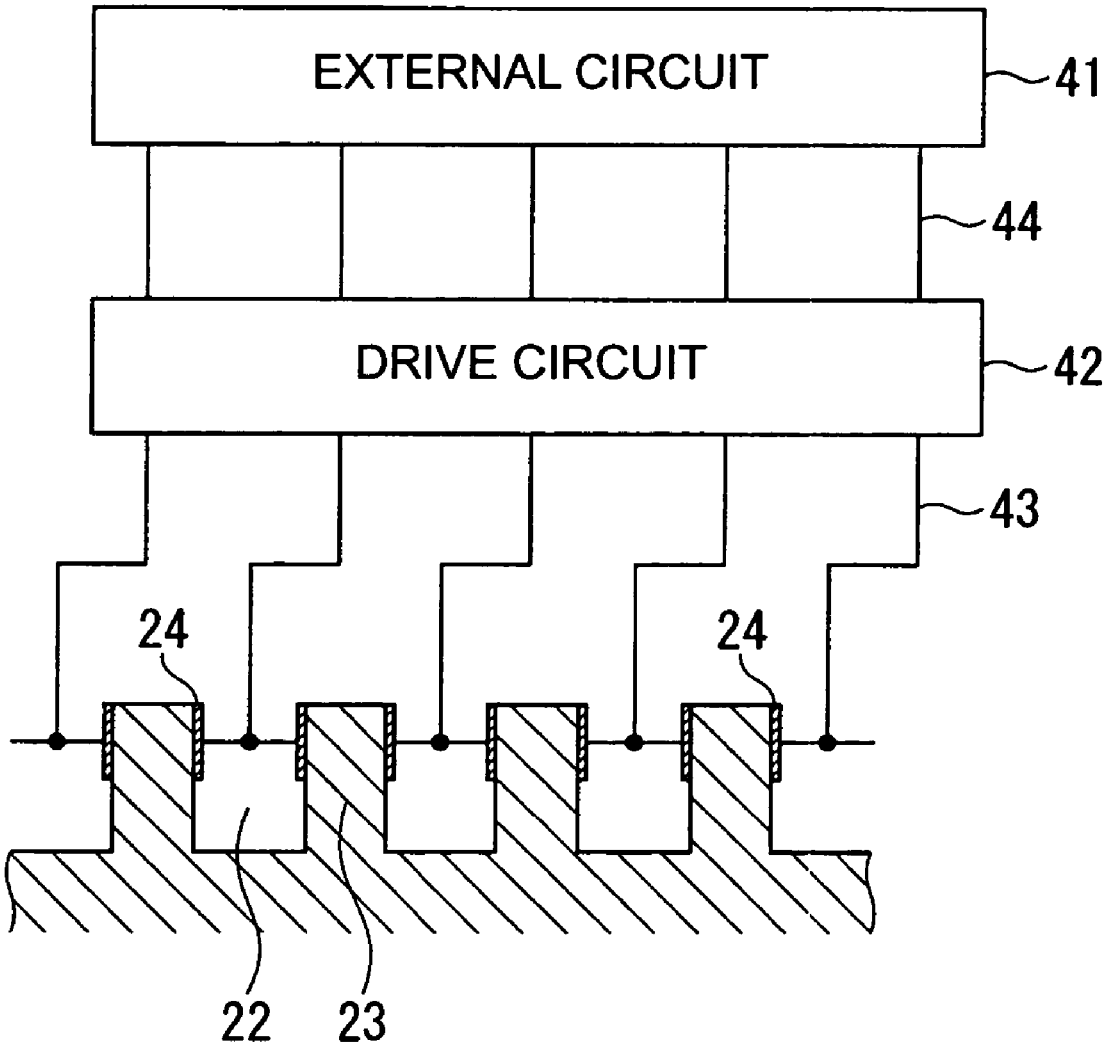
FIG. 4 is a schematic diagram showing the connection, by wiring, of a drive circuit to an ink jet head chip.

An explanation will now be given for the drive unit that outputs a drive signal to the pair of electrodes 24 provided on the side walls 23 of each ink chamber 22. FIG. 4 is a schematic diagram showing the connection, by wiring, of the drive circuit 42 to the ink jet head chip 20.

Power from an external device is supplied to the drive circuit 42, which is mounted on the wiring substrate 40 of the ink jet head 10, and an external signal, such as print data, is transmitted to the drive circuit 42 via external wiring lines 44 led in from an external circuit 41.

Further, the drive circuit 42 is connected via drive lines 43 to the pairs of electrodes 24 formed on the side walls 23 of the individual ink chambers 22. Therefore, an external signal received by the drive circuit 42 is transmitted as a drive pulse signal to the electrodes 24 of the ink chambers 22.

An explanation will now be given for drive pulse signals supplied to the ink chambers 22 in the normal ink discharge mode and in the ink non-discharge mode, with reference to cross sections of the piezoelectric ceramic plate in these modes. FIGS. 5A to 5D are diagrams showing a conventional ink jet head drive method.

In this case, an area on a recording medium whereat printing is to be performed is hereinafter referred to as a "print area", and an area whereat printing is not performed is referred to as a "non-print area". The ink chamber that is used for discharging ink onto this print area is an "ink chamber opposite the print area", and an ink chamber that is available for discharging ink during the ink discharge cycle, but is not used for discharging ink because it is located opposite the non-print area, is called an "ink chamber opposite the non-print area". The nozzle opening 28 for discharging ink from the "ink chamber opposite the print area" is called a "discharge portion", and the nozzle opening 28 for discharging (but actually not discharging) ink from the "ink chamber opposite the non-print area" is called a "non-discharge portion". Of course, the print area and the non-print area are gradually moved in accordance with the contents of print data. In this embodiment, assume that a signal is input indicating that, of the ink chambers 22*b* and 22*e* for which the discharge of ink is currently enabled, the ink chamber 22*b* is employed for the discharge of ink, and the ink chamber 22*e* is not used.

As shown in FIG. 5A, before the ink discharge process is started, a drive voltage is not applied to the electrodes 24*a* to 24*f*, and the side walls 23*a* to 23*f* are not deflected. Therefore, no ink is discharged. Following this, as shown in FIG. 5B, a positive drive voltage is applied only to the electrode 24*b* of the ink chamber 22*b*, not to the other electrodes. Then, the side wall 23*a* is deflected toward the ink chamber 22*a* while the side wall 23*b* is deflected toward the ink chamber 22*c*, and the volume of the ink chamber 22*b* is increased to prepare for the discharge of ink. This is because the side walls 23, which are made of PZT, are polarized in the vertical direction and are distorted by the application of a voltage.

Sequentially, in FIG. 5C, a positive drive voltage is applied to the electrodes 24*a*, 24*c*, 24*d*, 24*e* and 24*f*, and no drive voltage is applied to the electrode 24*b*. Then, the side walls 23*a* and 23*b* are deflected inward toward the ink chamber 22*b*, so that the volume of the ink chamber 22*b* is reduced and the pressure in the ink chamber 22*b* is increased. As a result, ink is discharged from the nozzle opening 28.

After the ink has been discharged, as shown in FIG. 5D, no drive voltage is applied to the electrodes 24*a* to 24*f*, and therefore, the side walls 23*a* to 23*f* return to the original shape shown in FIG. 5A.

When printing is to be continued, the drive voltages in FIGS. 5A to 5D need only be sequentially applied to the adjacent ink chambers 22 to continue to discharge ink. The period the drive voltages are to be applied is determined in accordance with the sizes of the actuators of the ink jet head and the characteristic of ink. The general pulse width is several μs to several tens of μs.

Furthermore, the volume of the ink chamber 22*c* is reduced at the time shown in FIG. 5B. However, since this change is only about a quarter of the change in the volume in the ink discharge mode, the discharge of ink does not occur. Also because of this change, the side wall (the side wall 23*c* in this embodiment) of an ink chamber that is adjacent to the ink chamber 22 from which ink is to be discharged must not be deflected. Therefore, not all the nozzles can be employed for the discharge of ink by the ink jet head 10, and the discharge of ink must be performed in a three-nozzle cycle. That is, the ink jet head 10 of a shared wall type repeats the ink discharge process three times in order to discharge ink from all the nozzles (three cycles).

Further, as is apparent from the drive pulse signals supplied to the ink chambers 24*d* to 24*f* in FIGS. 5A to 5D, when the discharge of ink is not performed, the same drive pulse signal is transmitted to the ink chamber (22*e*) and the two adjacent ink chambers (22*d* and 22*f*). Therefore, since distortion of the side walls 23 does not occur and pressure in the ink chamber 22*e* dose not fluctuate, ink is not discharged from the nozzle opening 28.

Figures 10A, 10B:
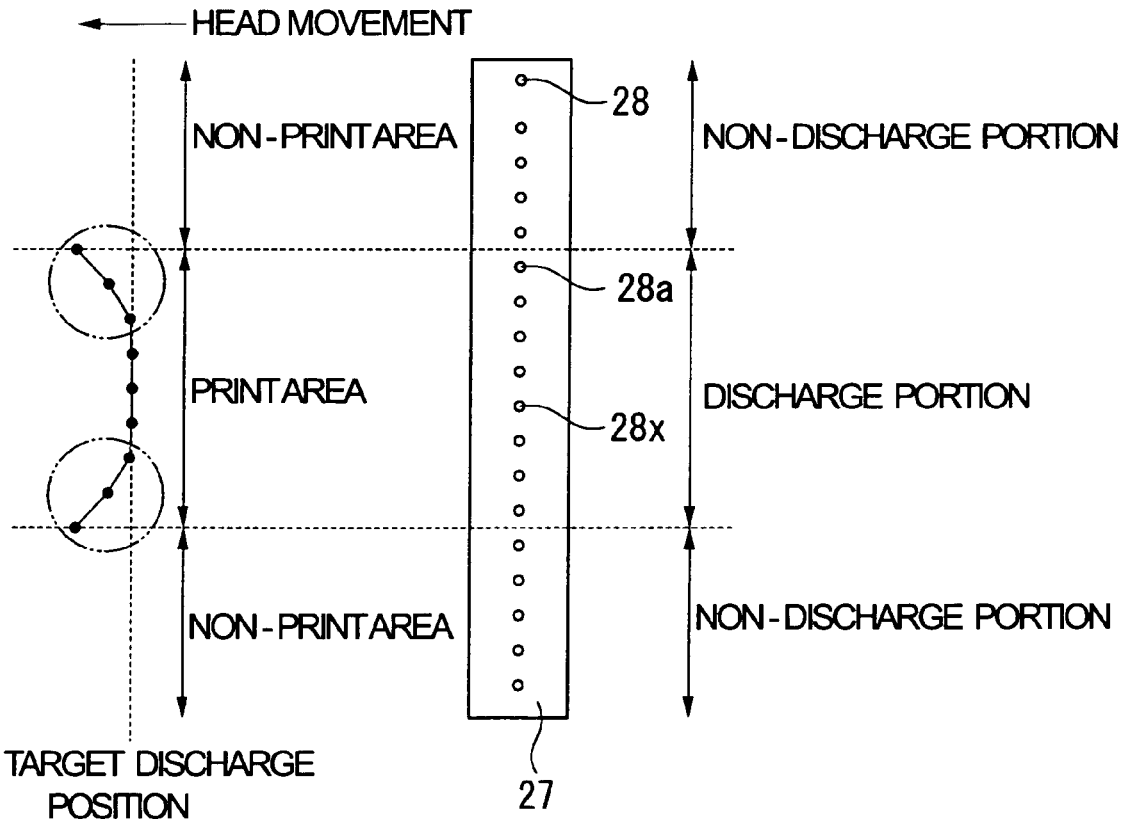
FIG.10A PRIOR ART
FIG.10B PRIOR ART
FIGS. 10A and 10B are diagrams showing a line printed by a conventional ink jet head drive method.

However, when the ink jet head is driven in this manner, and when, as previously described while referring to FIGS. 10A and 10B, an ink chamber for which ink discharge is available is located on the left of the ink chamber 22*a*, the speed at which ink discharged from the nozzle opening 28 consonant with the ink chamber 22*a* is lower than the speed at which ink is discharged from the nozzle openings 28 consonant with the other ink chambers 22.

To resolve this problem, an ink jet head drive method for the first embodiment will now be described in detail.

FIGS. 6A to 6D are diagrams showing the ink jet head drive method according to the first embodiment, i.e., for explaining a drive pulse signal supplied to the ink chamber (22*b*) opposite the print area, a drive pulse signal supplied to the ink chamber (22*e*) opposite the non-print area adjacent to the print area, and the states of the ink chambers.

Assume that an external signal, print data, is received from the external circuit 41 and indicates that, of the ink chambers 22*b* and 22*e* for which the discharge of ink is currently enabled, the ink chamber 22*b* is employed to discharge ink and the ink chamber 22*e* is not used. Further, assume that an ink chamber for which the discharge of ink is also available is contiguously located on the left of the ink chamber 22*a*, and an ink chamber for which the discharge of ink is not available is contiguously located on the right of the ink chamber 22*f*. That is, the ink chambers arranged on the left of the ink chamber 22*c* are opposite the print area of the recording medium, and the ink chambers arranged on the right of the ink chamber 22*d* are opposite the non-print area of the recording medium.

Figure 6:
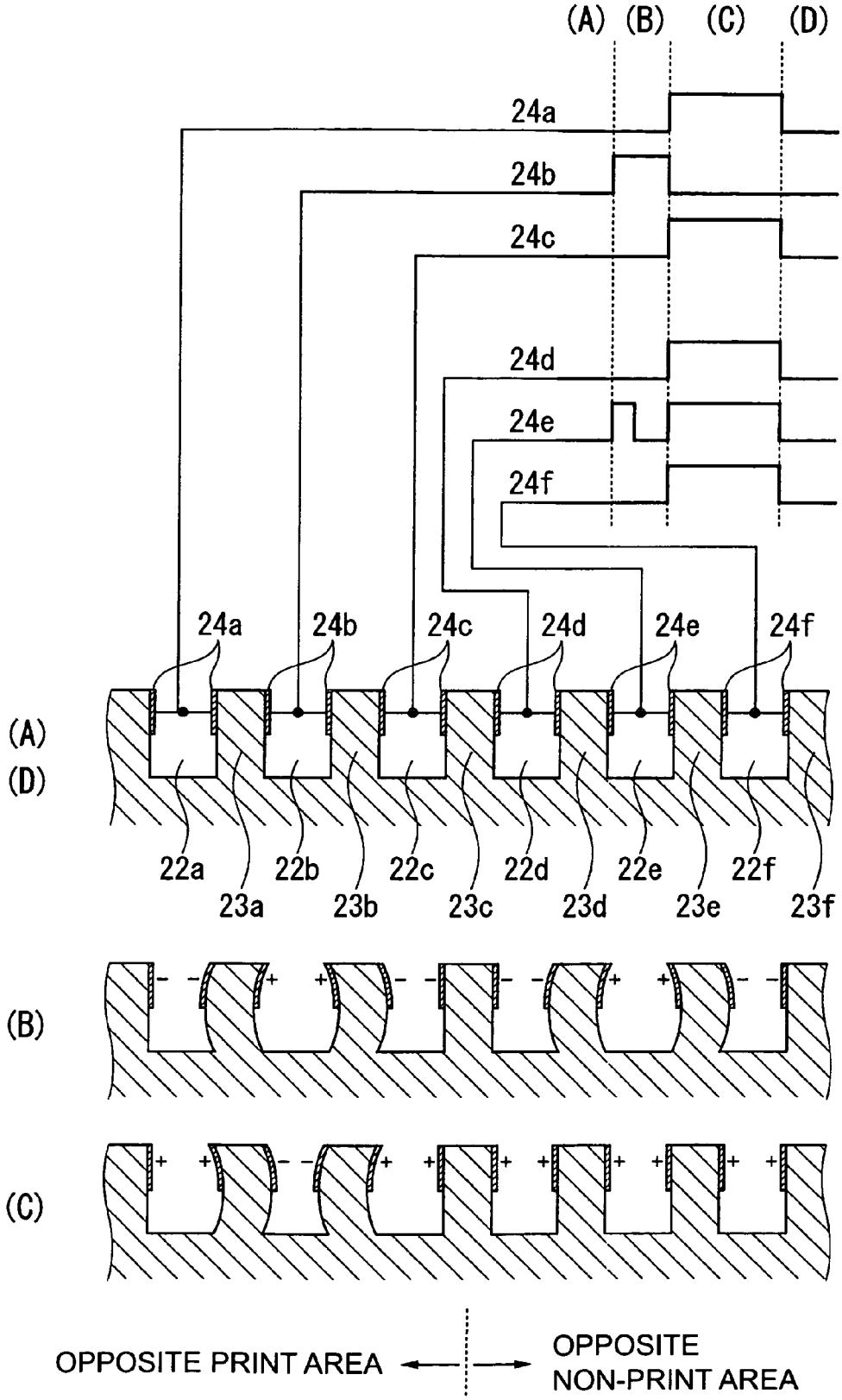
FIGS. 6A to 6D are diagrams showing an ink jet head drive method according to a first embodiment of the present invention.

As is done in accordance with the conventional ink jet head drive method, before the ink discharge process is started, as shown in FIG. 6A, no drive voltage is applied to the electrodes 24*a* to 24*f*, and the side walls 23*a* to 23*f* are not deflected. Therefore, no ink is discharged. Following this, as shown in FIG. 6B, a positive drive voltage is applied to the electrode 24*b* of the ink chamber 22*b* from which ink is to be discharged (reserve drive pulse signal). A positive drive voltage is also applied to the electrode 24*e* of the ink chamber 22*e* for which the discharge of ink is available but from which the discharge of ink is not actually performed (second drive pulse signal). No drive voltage is applied to the other electrodes 24. Then, the side wall 23*a* is deflected toward the ink chamber 22*a*, while the side wall 23*b* is deflected toward the ink chamber 22*c*, and the volume of the ink chamber 22*b* is increased to prepare for the discharge of ink. Further, the side wall 23*d* is deflected toward the ink chamber 22*d* and the side wall 23*d* is deflected toward the ink chamber 22*f*.

Sequentially, in FIG. 6C, a positive drive voltage is applied to the electrodes 24*a*, 24*c*, 24*d*, 24*e* and 24*f*, but no drive voltage is applied to the electrode 24*b* (discharge drive pulse signal). Then, the side walls 23*a* and 23*b* are deflected toward the ink chamber 22*b*, so that the volume of the ink chamber 22*b* is reduced, and the pressure in the ink chamber 22*b* is increased. As a result, ink is discharged from the nozzle opening 28 consonant with the ink chamber 22*b*. The reserve drive pulse signal and the discharge drive pulse signal are collectively called a first drive pulse signal.

On the other hand, since the ink chamber 22*e* is simply returned to its original shape, and the volume thereof is not changed, ink is not discharged from the nozzle opening 28 consonant with the ink chamber 22*e*. However, vibrations are generated because the second drive pulse signal has also been transmitted to the side walls 23*d* and 23*e*. As described above, in the ink discharge mode, the second drive pulse signal is transmitted to the ink chambers opposite the non-print area, adjacent to the print area, that are not used for the discharge of ink.

Therefore, a difference in the internal vibration energy can be reduced between the ink chamber used for the discharge of ink and the ink chamber that is not used. As a result, ink can be discharged from the nozzle openings located at the ends of the ink discharge nozzle array (the discharge portion), at the same speed as from the nozzle openings located in the middle.

Figure 5:
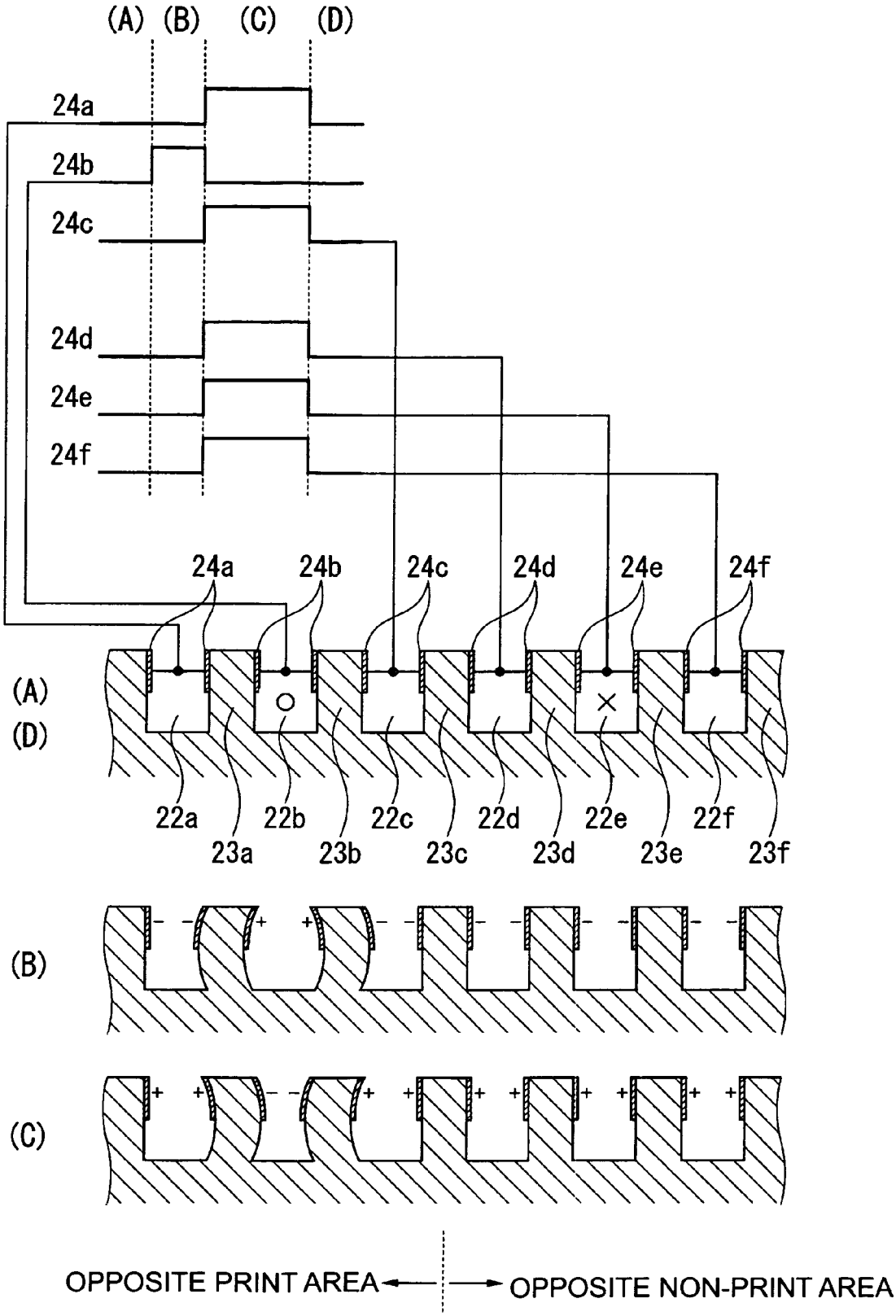
FIGS. 5A to 5D are diagrams showing the normal ink jet head drive method.

In addition, in the same manner that the same drive pulse signal is transmitted to the ink chamber 22*e* and the two adjacent ink chambers 22 in FIG. 5, the same drive pulse signal is transmitted to the ink chambers 22 opposite the non-print area that is not adjacent to the print area and to the adjacent ink chambers 22. As a result, distortion of the side walls 23 can be prevented. As described above, since the second drive pulse signal is transmitted only to the ink chamber opposite the non-print area that is adjacent to the print area, the other side walls 23 are not distorted unnecessarily. Therefore, reliability is increased, and power consumption is reduced.

Furthermore, in the ink discharge mode, the drive voltage (drive pulse signal) is not applied to the electrode 24*b* of the ink chamber 22*b* for which the discharge of ink is actually performed, but the drive voltage is applied to the electrodes 24*a* and 24*c* of the adjacent ink chambers to change the volume of the ink chamber 22*b*. As is apparent from this operation, the "drive pulse signal" of this embodiment is not always a signal to be transmitted to the electrode 24 provided for the ink chamber 22 whose volume is to be changed, but can be a signal to be transmitted to the electrodes 24 provided for the ink chambers adjacent to this ink chamber 22 in order to change the volume of the ink chamber 22.

A detailed explanation will be given for a reserve drive signal, which is a positive drive voltage to be applied to the ink chamber 22 used for the discharge of ink, and the second drive pulse signal, which is a positive drive voltage to be applied to the ink chamber 22 for which the discharge of ink is available, but which is not used.

Figure 7:
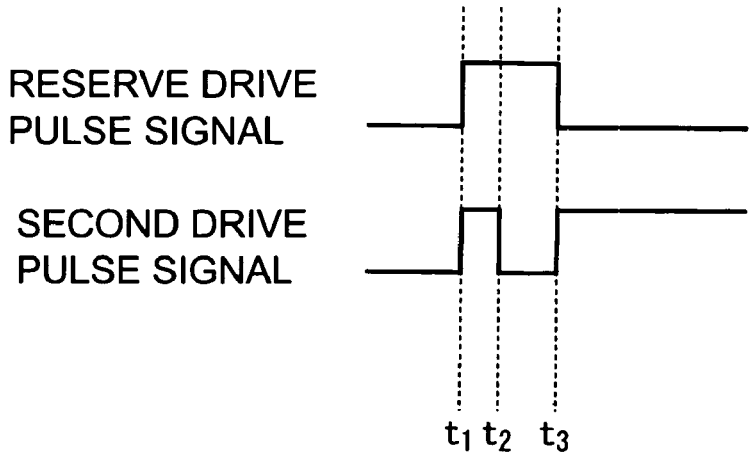
FIG. 7 is a diagram showing drive pulse signals according to the first embodiment.

The second drive pulse signal is input together with the reserve drive pulse signal included in the first drive pulse signal. When the phase is matched with the drive pulse signal applied to the ink chamber used for the discharge of ink, stability can be provided for the discharge of ink. Further, it is preferable that the voltage value for the second drive pulse signal be equal to the voltage value for the reserve drive pulse signal. It is also preferable that the pulse width of the second drive pulse signal be 30% to 60% that of the reserve drive pulse signal. That is, as shown in FIG. 7, when the input start time for the reserve drive pulse signal and the second drive pulse signal is denoted by t1, the input end time for the second drive pulse signal is denoted by t2, and the input end time for the reserve drive pulse signal is denoted by t3, it is preferable that $0.3\ (t3-t1) \leqq t2-t1 \leqq 0.6\ (t3-t1)$ be established.

Figure 8:
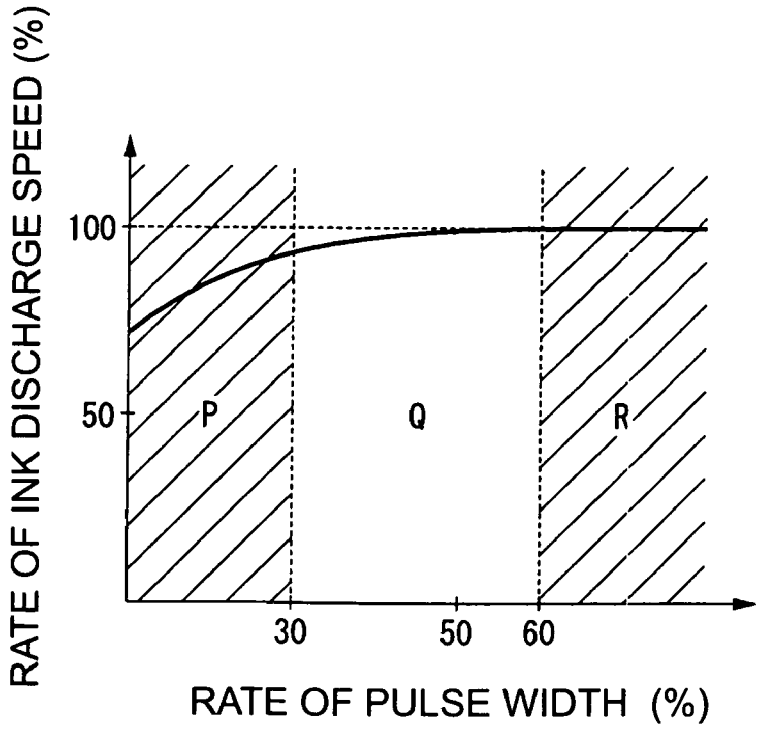
FIG. 8 is a graph showing a change in the rate of an ink discharge speed relative to the rate of the pulse width of a drive signal according to the first embodiment.

FIG. 8 is a graph showing the change in the rate of the ink discharge speed relative to the rate of the pulse width of the drive pulse signal according to the first embodiment. The horizontal axis represents the ratio of the pulse width of the second drive pulse signal to the pulse width of the reserve drive signal. The vertical axis represents the ratio of the ink discharge speed for the nozzle opening (28*a* in FIG. 10), which is opposite the print area and located nearest the non-discharge portion, relative to the ink discharge speed for the nozzle opening (28*x* in FIG. 10) that is located in the center.

When the rate of the pulse width is 0%, the second drive pulse is not input, and the ink discharge speed for the nozzle opening located nearest the non-discharge portion is 70% to 80% that for the nozzle opening located in the center. When the rate of the pulse width is increased, the rate of the ink discharge speed is increased, and the ink discharge speeds for the two opening nozzles are equal (100%). Specifically, when the rate of the pulse width is less than 30%, satisfactory effects can not be obtained by increasing the ink discharge speed (area P in FIG. 8). When the rate of the pulse width exceeds 60%, the rate of the ink discharge speed is 100%; however, the discharge of ink also occurs from the nozzle opening in the non-discharge portion that corresponds to the ink chamber whereat the second drive pulse signal has been input (area R in FIG. 8). Therefore, the ink jet head drive method of this embodiment is effective when the pulse width of the second drive pulse signal is 30% to 60% that of the reserve drive pulse signal (area Q in FIG. 8).

The second drive pulse signal is transmitted not only to a single ink chamber that is opposite the non-print area of the recording medium and is not used for the discharge of ink, and that is immediately adjacent to the ink chamber opposite the print area of the recording medium and is used to discharge ink, but also to a plurality of ink chambers opposite the non-print area adjacent to the print area. Specifically, when the second drive pulse signal is transmitted to about six of the ink chambers opposite the non-print area adjacent to the print area, at about the same speed, ink can be discharged from all the ink chambers facing the print area.

Figure 9:
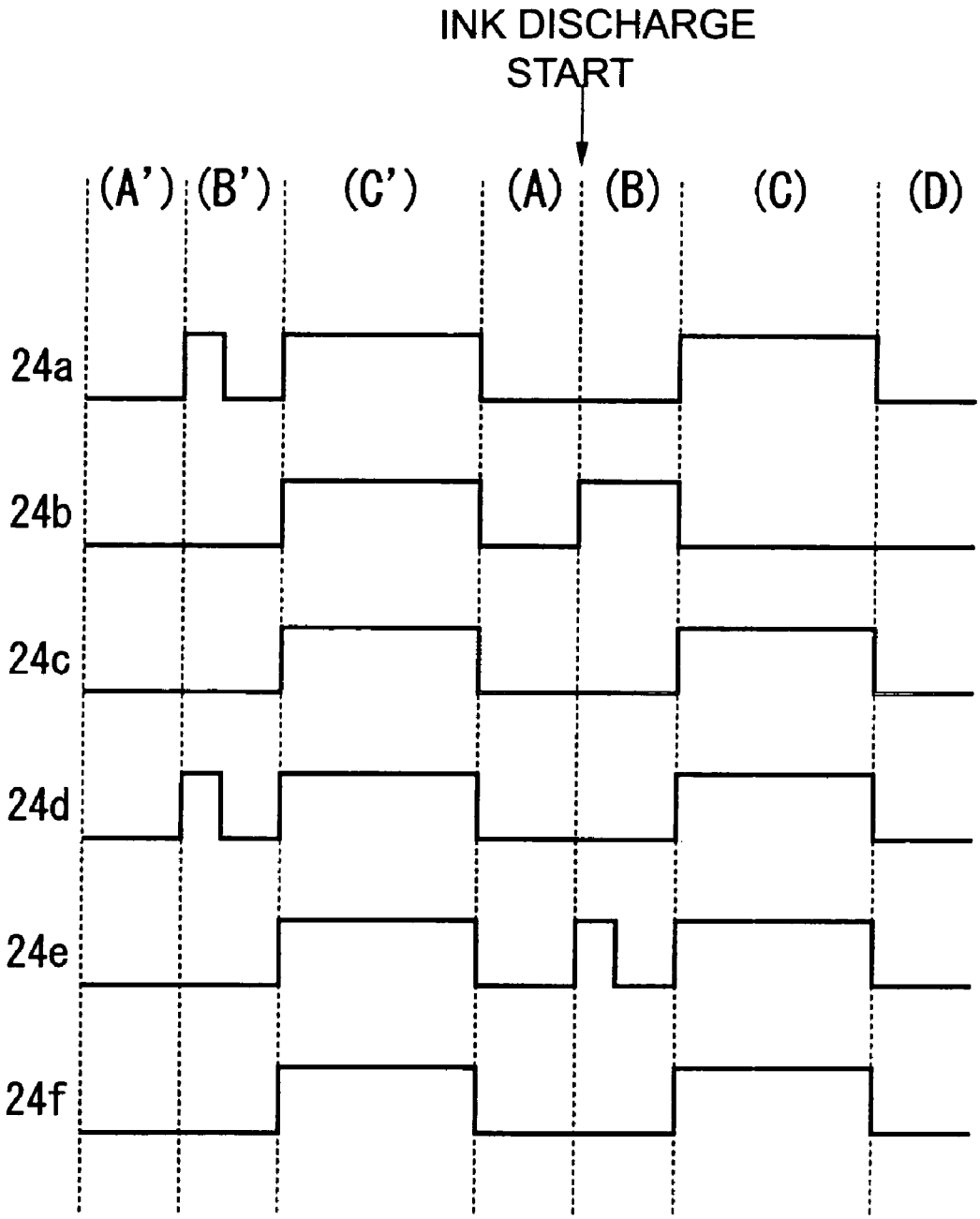
FIG. 9 is a diagram showing an ink jet head drive method according to a second embodiment of the present invention.

In addition, as an ink jet head drive method for a second embodiment of the present invention, as shown in FIGS. 9A', 9B' and 9C', a third drive pulse signal may also be transmitted to all the ink chambers 22 that are ready to start the discharge of ink, regardless of whether the ink chambers 22 face the print area on a recording medium or the non-print area. In this case, ink chambers 22*b* and 22*e* are those for which the discharge of ink is enabled in the cycle shown in FIGS. 9A, 9B and 9C, while ink chambers 22*a* and 22*d* are those for which the discharge of ink is enabled in the cycle shown in FIGS. 9A', 9B' and 9C'. Therefore, a drive pulse signal having a voltage value or a pulse width at which the discharge of ink does not occur is defined as the third drive pulse. When weak vibrations are applied in advance to all the ink chambers 22 in this manner, printing can be performed at the optimal speed immediately after the ink discharge operation has been started. For the third drive pulse signal that is input before the ink discharge operation, an appropriate pulse width at which the discharge of ink does not occur is designated in accordance with the specification for the ink jet head 10 and the characteristic of ink.

Further, while taking power consumption by the ink jet head 10 into account, immediately before the discharge of ink is started, the third drive signal may be transmitted only to the ink chamber 22 facing the print area. In this case, specific effects can also be obtained.

Of course, the third drive pulse signal can have the same waveform as has the second drive pulse signal.

As described above, the second drive pulse, which does not cause the discharge of ink is transmitted to the ink chamber 22 for which the discharge of ink is about to start, and is also transmitted to the ink chamber 22 opposite the non-print area that is adjacent to the print area, during the ink discharge operation. Therefore, immediately after the printing is started, the optimal ink discharge speed can be obtained for all the ink chambers, and an increase can be provided in the printing speed and in the stability of the printing quality.

Further, according to the first or the second embodiment of the invention, the second drive pulse signal has been input to the ink chamber for which the discharge of ink is ready to start, and the ink chamber opposite the non-print area that is adjacent to the print area. During the discharge cycle, the second drive signal may be transmitted all the ink chambers 22 for which the discharge of ink is available, but from which ink is not discharged. Generally, since these ink chambers are those opposite the non-print area, a drive pulse signal having the same waveform as that transmitted to the adjacent ink chambers is input to prevent the distortion of the side walls, and in the above described case, the second drive pulse signal is transmitted to such ink chambers 22. Without alteration of the conventional drive circuit being required, the setup of the drive waveform need only be changed to reduce the speed of the ink discharged from the ink chambers at both ends of the contiguous discharge portion, and to improve the image quality.

In the above embodiments, the ink jet head wherein a pair of electrodes 24 are formed on the side walls 23 of each ink chamber 22 has been explained as an example. The ink jet head driven by the ink jet drive method of the invention, or mounted on the ink jet recording apparatus of the invention, is not limited to this. For example, an ink jet head may be employed wherein a dummy ink chamber that is not filled with ink may be formed between ink chambers that are filled with ink. The same effects as obtained in the embodiments can also be acquired for an ink jet head wherein a drive pulse signal is transmitted to the electrode provided in the ink chamber to change the volume of the ink chamber.

Furthermore, according to the present invention, a serial type ink jet recording apparatus wherein an ink jet head is moved in the main scanning direction has been explained as an example. However, the present invention is not especially limited to this type of recording apparatus, and can be applied for other types of recording apparatus, such as a line type ink jet recording apparatus wherein an ink jet head is fixed.

What is claimed is:

1. An ink jet head driving method comprising:

transmitting, in accordance with print data received from an external circuit, a first drive pulse signal to a first actuator that is formed in a first ink chamber from which ink is to be discharged and that confronts a print area on a recording medium whereat printing is performed with the discharged ink during a printing operation, the first drive pulse signal comprising a reserve drive pulse signal transmitted to temporarily increase a volume of the first ink chamber from an original state to an expanded state and a discharge drive pulse signal transmitted sequentially with the reserve drive pulse signal to temporarily reduce the volume of the first ink chamber from the expanded state to a compressed state in which the volume of the first ink chamber is less than the volume thereof in the original state, thereby causing ink to be discharged from the first ink chamber to the confronting print area of the recording medium; and transmitting, in synchronization with the reserve drive pulse signal, a second drive pulse signal to a second actuator that is formed in a second ink chamber configured to discharge ink and that confronts a non-print area of the recording medium adjacent to the print area and whereat printing is not performed during the duration of the printing operation, the second drive pulse signal having one of a voltage value and a pulse width at which the volume of the second ink chamber is varied but does not cause ink to be discharged from the second ink chamber to the confronting non-print area of the recording medium.

2. An ink jet head drive method according to claim 1; wherein the second drive pulse signal is transmitted with a pulse width that is 30 to 60% that of the reserve drive pulse signal.

3. An ink jet head drive method according to claim 1; wherein the second drive pulse signal is transmitted with a voltage value equal to that of the reserve drive pulse signal.

4. An ink jet head drive method according to claim 1; further comprising the step of transmitting to the first actuator, prior to transmission thereto of the first drive pulse signal, a third drive pulse signal having one of a voltage value and a pulse width that does not cause ink to be discharged from the first ink chamber.

5. An ink jet head drive method according to claim 1; wherein the first and second chambers are arranged parallel to one another, each of the first and second chambers having a pair of inner side walls; and wherein each of the first and second actuators comprises electrodes disposed on the respective inner side walls.

6. An ink jet head drive method according to claim 1; wherein the second drive pulse signal and the reserve drive pulse signal are transmitted at the same time.

7. An ink jet head drive method according to claim 6; further comprising the step of transmitting to the first actuator, prior to transmission thereto of the first drive pulse signal, a third drive pulse signal having one of a voltage value and a pulse width that does not cause ink to be discharged from the first ink chamber.

8. An ink jet head drive method according to claim 6; wherein the first and second chambers are arranged parallel to one another, each of the first and second chambers having a pair of inner side walls; and wherein each of the first and second actuators comprises electrodes disposed on the respective inner side walls.

9. An ink jet head drive method according to claim 6; wherein the second drive pulse signal is transmitted with a pulse width that is 30 to 60% that of the reserve drive pulse signal.

10. An ink jet head drive method according to claim 9; wherein the first and second chambers are arranged parallel to one another, each of the first and second chambers having a pair of inner side walls; and wherein each of the first and second actuators comprises electrodes disposed on the respective inner side walls.

11. An ink jet head drive method according to claim 9; wherein the second drive pulse signal is transmitted with a voltage value equal to that of the reserve drive pulse signal.

12. An ink jet head drive method according to claim 11; wherein the first and second chambers are arranged parallel to one another, each of the first and second chambers having a pair of inner side walls; and wherein each of the first and second actuators comprises electrodes disposed on the respective inner side walls.

13. An ink jet head drive method according to claim 11; further comprising the step of transmitting to the first actuator, prior to transmission thereto of the first drive pulse signal, a third drive pulse signal having one of a voltage value and a pulse width that does not cause ink to be discharged from the first ink chamber.

14. An ink jet head drive method according to claim 13; wherein the third drive pulse signal has a waveform that is the same as that of the second drive pulse signal.

15. An ink jet head drive method according to claim 14; wherein the first and second chambers are arranged parallel to one another, each of the first and second chambers having a pair of inner side walls; and wherein each of the first and second actuators comprises electrodes disposed on the respective inner side walls.

16. An ink jet head comprising:

an ink jet head chip including a plurality of ink chambers that receive ink supplied by an ink supply unit and from which the ink is to be discharged, each of the ink chambers having an actuator for varying a volume of the ink chamber; and a drive unit operable to (a) transmit, in accordance with print data received from an external circuit, a first drive pulse signal to the actuator of at least a first one of the ink chambers that confronts a print area on a recording medium whereat printing is performed during a printing operation, the first drive pulse signal comprising a reserve drive pulse signal transmitted to temporarily increase a volume of the first one of the ink chambers from an original state to an expanded state and a discharge drive pulse signal transmitted sequentially with the reserve drive pulse signal to temporarily reduce the volume of the first one of the ink chambers from the expanded state to a compressed state in which the volume of the first one of the ink chambers is less than the volume thereof in the original state, thereby causing ink to be discharged from the first one of the ink chambers to the confronting print area on the recording medium, and (b) transmit, in synchronization with the reserve drive pulse signal, a second drive pulse signal to the actuator of at least a second one of the ink chambers that confronts a non-print area of the recording medium adjacent to the print area thereof and whereat printing is not performed during the duration of the printing operation, the second drive pulse signal having one of a voltage value and a pulse width at which the volume of the second one of the ink chambers is varied but does not cause ink to be discharged from the second one of the ink chambers to the confronting non-print area of the recording medium.

17. An ink jet recording apparatus comprising:

an ink jet head according to claim 16;

an ink supply unit for supplying ink to the ink chambers of the ink jet head; and a recording medium conveying portion that conveys the recording medium onto which ink is discharged by the ink chambers of the ink jet head.

18. An ink jet head driving method comprising:

providing an ink jet head comprised of a substrate, a plurality of partition walls each having a pair of deformable side walls and disposed on a main surface of the substrate in spaced apart relation at a preselected interval to form a plurality of chambers each for receiving ink, and a plurality of electrodes each connected to respective ones of the side walls of the partition walls and driven by a drive pulse to deform the side walls to vary the volume in the chambers to thereby eject ink from the chambers, the chambers defining a set of first chambers confronting a print area of a recording medium on which ink is to be discharged and printing is performed during a printing operation, and a set of second chambers confronting a non-print area of the recording medium on which ink is not discharged and printing is not performed during the duration of the printing operation;

transmitting a first drive pulse signal to the electrodes connected to the deformable side walls of at least one of the first chambers corresponding to a preselected first chamber, the first drive pulse signal comprising a reserve drive pulse signal transmitted to deform the side walls of the preselected first chamber to temporarily increase a volume of the first chamber from an original state to an expanded state and a discharge drive pulse signal transmitted sequentially with the reserve drive pulse signal to temporarily reduce the volume of the first chamber from the expanded state to a compressed state in which the volume of the first chamber is less than the volume thereof in the original state, thereby causing ink to be discharged from the first chamber to the print area of the recording medium; and transmitting, in synchronization with the reserve drive pulse signal, a second drive pulse signal to the deformable side walls of at least one of the second chambers corresponding to a preselected second chamber, the second drive pulse signal having a pulse width at which the volume of the preselected second chamber is varied but does not cause ink to be discharged from the preselected second chamber to the non-print area of the recording medium.

19. An ink jet head drive method according to claim 18; wherein the second drive pulse signal and the reserve drive pulse signal are transmitted at the same time.

20. An ink jet head drive method according to claim 18; wherein the pulse width of the second drive pulse signal is 30 to 60% of a pulse width of the transmitted reserve drive pulse signal.

21. An ink jet head drive method according to claim 18; wherein the second drive pulse signal is transmitted with a voltage value equal to that of the transmitted reserve drive pulse signal.

* * * * *